US008210235B2

(12) United States Patent
Moos et al.

(10) Patent No.: US 8,210,235 B2
(45) Date of Patent: Jul. 3, 2012

(54) MOLD FOR THE CONTINUOUS CASTING OF METAL AND A PROCESS FOR PRODUCING SUCH A MOLD

(75) Inventors: Oliver Moos, Lippoldswilen (CH); Rudolf Bosshard, Salenstein (CH)

(73) Assignee: Gautschi Engineering GmbH, Tägerwilen (CH)

( * ) Notice: Subject to any disclaimer, the term of this patent is extended or adjusted under 35 U.S.C. 154(b) by 0 days.

(21) Appl. No.: 12/677,891

(22) PCT Filed: Aug. 28, 2008

(86) PCT No.: PCT/EP2008/007062

§ 371 (c)(1),
(2), (4) Date: Nov. 16, 2010

(87) PCT Pub. No.: WO2009/036870

PCT Pub. Date: Mar. 26, 2009

(65) Prior Publication Data

US 2011/0048662 A1 Mar. 3, 2011

(30) Foreign Application Priority Data

Sep. 12, 2007 (DE) ..... 10 2007 043 386

(51) Int. Cl.
*B22D 11/00* (2006.01)
*B22D 11/045* (2006.01)

(52) U.S. Cl. ..... 164/440; 164/418

(58) Field of Classification Search ..... 164/418, 164/459, 440, 490
See application file for complete search history.

(56) References Cited

U.S. PATENT DOCUMENTS

| | | | |
|---|---|---|---|
| 3,857,437 | A | 12/1974 | Watts |
| 4,653,570 | A | 3/1987 | Stonecliffe et al. |
| 6,135,197 | A | 10/2000 | Jolivet et al. |
| 2002/0139508 | A1 | 10/2002 | Schneider et al. |

FOREIGN PATENT DOCUMENTS

| | | | |
|---|---|---|---|
| DE | 2412424 | | 10/1974 |
| DE | 25 20 091 | A1 | 11/1976 |
| DE | 69703582 | T2 | 6/2001 |
| DE | 69909052 | T2 | 4/2004 |
| EP | 0187513 | A2 | 7/1986 |
| EP | 1245310 | B1 | 6/2005 |
| JP | 56011164 | A | 2/1981 |
| JP | 62176646 | A | 8/1987 |
| JP | 62224453 | A | 10/1987 |

OTHER PUBLICATIONS

Int'l Preliminary Report on Patentability issued Apr. 9, 2009 in Int'l Application No. PCT/EP2008/007062.

*Primary Examiner* — Kuang Lin
(74) *Attorney, Agent, or Firm* — Panitch Schwarze Belisario & Nadel LLP

(57) ABSTRACT

A mold (10) for the continuous casting of metal including a cooled running surface (11) and a guide (12) for molten metal. The guide is made of a refractory material and is disposed upstream of the running surface (11) in the direction of flow. The guide (12) is radially prestressed.

7 Claims, 6 Drawing Sheets

MOLD FOR THE CONTINUOUS CASTING OF METAL AND A PROCESS FOR PRODUCING SUCH A MOLD

CROSS-REFERENCE TO RELATED APPLICATIONS

This application is a Section 371 of International Application No. PCT/EP2008/007062, filed Aug. 28, 2008, which was published in the German language on Mar. 26, 2009, under International Publication No. WO 2009/036870 A1 and the disclosure of which is incorporated herein by reference.

BACKGROUND OF THE INVENTION

The invention relates to a mold for the continuous casting of metal having a coolable running surface and a guide for molten metal comprising a refractory material, wherein the guide is disposed upstream of the running surface in the direction of flow. The invention also relates to a process for producing such a mold. A mold of this type is disclosed, for example, in European Patent EP 1 245 310 B1.

The mold referred to there is a hot head mold that is used for continuous vertical casting. The known hot head mold comprises a plurality of axial and concentrically disposed rings which together form the mold's flow channel. The mold's inlet opening is limited by the hot head or thermal cover, which comprises an inner ring of a refractory material and an outer ring radially encompassing the inner ring. The outer ring, on its rear end in the direction of casting, forms a flange which is joined to the mold casing. The refractory inner ring of the thermal cover is clamped axially by a clamping ring attached on the mold inlet side. To do this, the clamping ring overlaps both the inner and also the outer ring, whereby the outer ring is designed somewhat shorter in the longitudinal direction than the inner ring so that the inner ring is fixed axially to the outer ring by a suitable screwed joint of the clamping ring. Disposed downstream of the hot head in the direction of flow is a ring system which is provided for the supply of release agent and a functional ring in addition to a release agent distributor. The functional ring forms a portion of the mold's running surface, which is cooled by a cooling system.

The mold's inlet side is joined to a pouring ladle and the outlet side to a continuous casting device.

The molds generally used for continuous horizontal casting are constructed in a similar manner. Unlike the molds designed for continuous vertical casting, the molds provided for continuous horizontal casting have a nozzle plate which is disposed perpendicular to the direction of flow or strand withdrawal direction. The nozzle plate is made from a refractory material and has a nozzle aperture through which the molten metal gets into the mold. Downstream of the nozzle plate in the direction of flow or strand withdrawal direction is a running surface equipped with an oil supply, the running surface being cooled.

Particularly when starting casting, extreme temperature gradients occur in the region of the thermal cover and nozzle plate, leading to a thermally induced change in the dimensions of the nozzle plate and thermal cover. Internal stresses which may lead or actually do lead to cracks are created in the material due to thermal expansion of the nozzle plate and thermal cover. In the worst case, bleeding occurs and the mold fails.

BRIEF SUMMARY OF THE INVENTION

The object of the invention is to improve a mold of the type referred to at the outset with regard to reliable, failure-free operation of the mold.

A significant point of the invention is to provide a mold for the continuous casting of metal having a coolable running surface and a guide for molten metal comprising a refractory material disposed upstream of the running surface in the direction of flow. According to the invention, the guide is radially prestressed.

The formation of tensile stresses in the refractory material, which may occur due to thermal expansion, is reduced or abolished completely by radial prestressing of the guide. This lowers the risk of crack formation. In the event that a crack nevertheless occurs in the guide, radial prestressing means that crack propagation is limited and the crack is prevented from becoming larger. This creates an added safeguard which reduces the risk of the mold failing because of bleeding.

The invention therefore covers both vertical casting molds and also horizontal casting molds.

In a preferred embodiment, the guide is press-fitted to a holding element, in particular a holding ring. Thus, radial prestressing of the guide element is implemented in a simple manner. In this case an outer circumferential surface of the guide and an inner circumferential surface of the holding element may each be formed conically or cylindrically. In the case of the conical design, this is a tapered press-fit, and in the case of the cylindrical design it is a shrink-bond.

Alternatively, a radially stressed sleeve may be disposed on the outer circumference of the guide element by which radial prestressing is also implemented.

Preferably, the guide element comprises a nozzle plate disposed substantially perpendicular to the flow direction or strand withdrawal direction. This embodiment is suitable for continuous horizontal casting. Alternatively, the guide may comprise a thermal cover that forms an axial flow channel. This embodiment is provided for continuous vertical casting.

In a preferred embodiment of the invention, the holding element, in particular the holding ring, is designed in two parts such that both parts of the holding element, in particular the holding ring, can take over different functions. The holding element is not restricted to the two-part shape, but may generally be of multipart design.

Preferably the holding element, in particular the holding ring, comprises a fastener and a clamp wherein the fastener and the clamp are prestressed in the mold's axial direction, in particular are prestressed against each other. The holding element, in particular the holding ring, may be mounted, for example, on the mold's casing using the fastener whereby radial prestressing of the guide is applied by the clamp. For this purpose the fastener and the clamp are prestressed in the mold's axial direction, in particular are prestressed against each other. This has the advantage of achieving a compact and rugged method of constructing the mold wherein radial prestressing of the guide can be adjusted accurately and reproducibly. In this case, the clamp is adapted in such a way that the prestress between the clamp and the fastener acting in the mold's axial direction has a radial component, such that the guide can be loaded with a radial prestress.

The process according to the invention for producing a mold is based on the idea of joining a guide for molten metal, comprising a refractory material, and a coolable running surface, wherein the guide is radially prestressed. The guide is joined to a holding element, in particular a holding ring, which comprises a fastener and a clamp. The fastener and the clamp are prestressed in the mold's axial direction, in particular are prestressed against each other.

The process has the advantage of specifically adjusting the radial prestress of the guide by loading the clamp with a predetermined axial prestress. Moreover, as a result the guide may be centered by the clamp for assembly.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

FIGS. 1 to 5 illustrate molds that are provided for continuous horizontal casting of metal. The invention can also be used for molds for continuous vertical casting.

Figure 1:
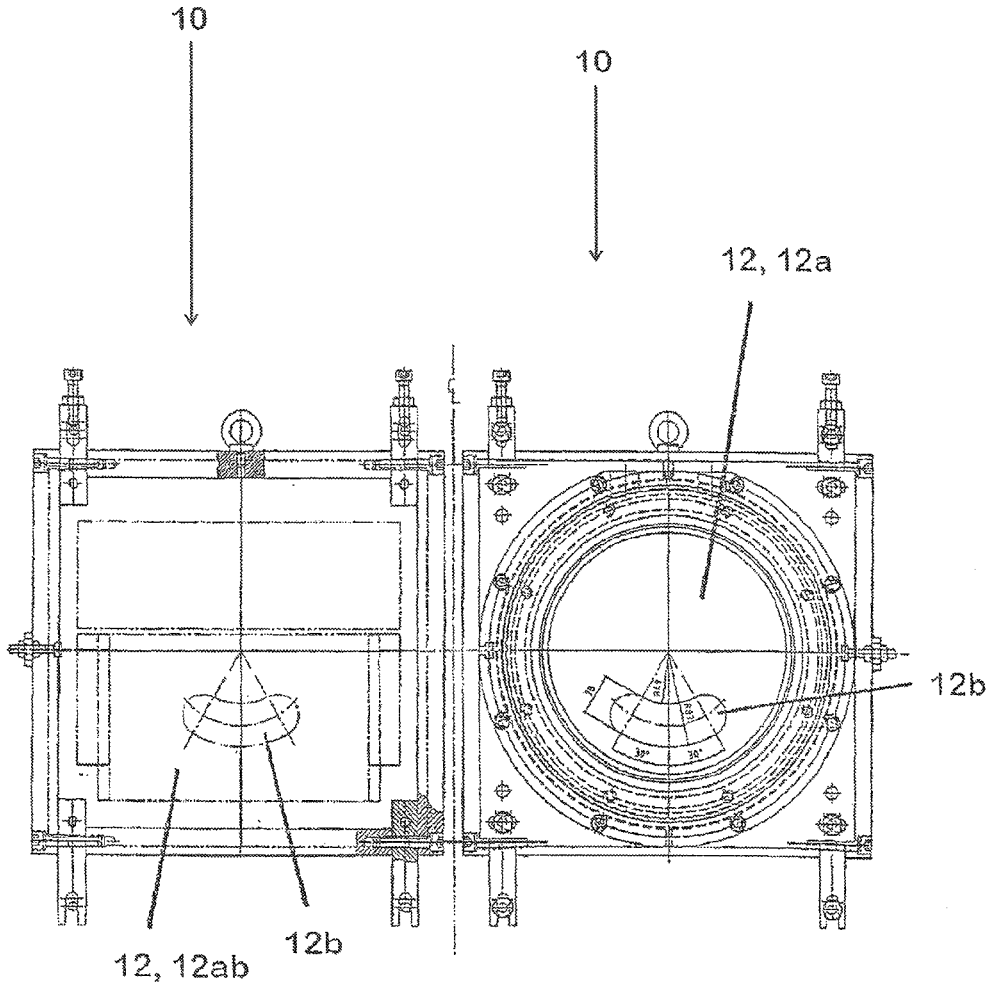
FIG. 1 is a plan view from above onto the inlet side (left-hand diagram) and outlet side (right-hand diagram) of a mold in accordance with an embodiment according to the invention.
Figure 2:
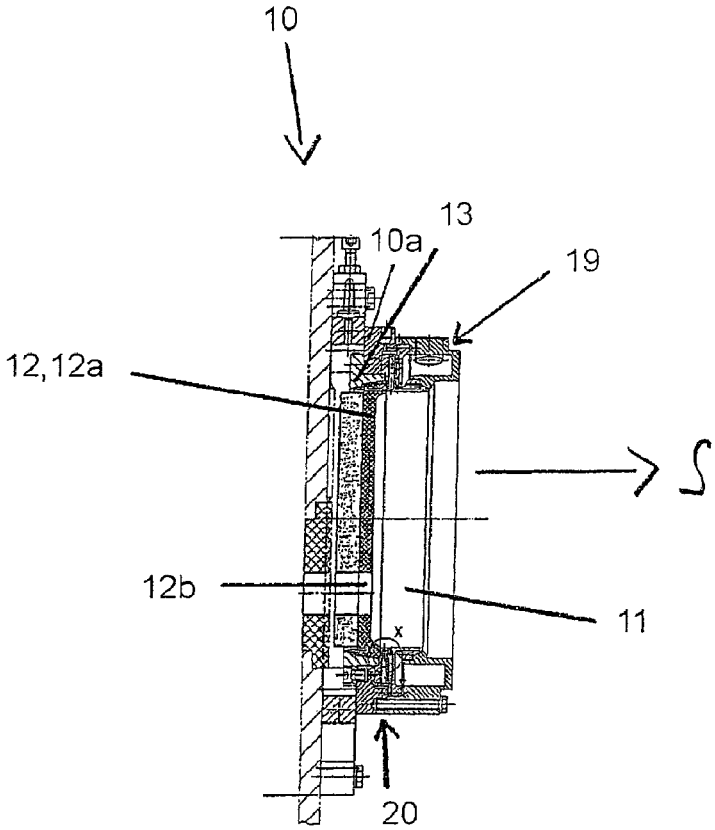
FIG. 2 is a longitudinal section through the mold according to FIG. 1.
Figure 3:
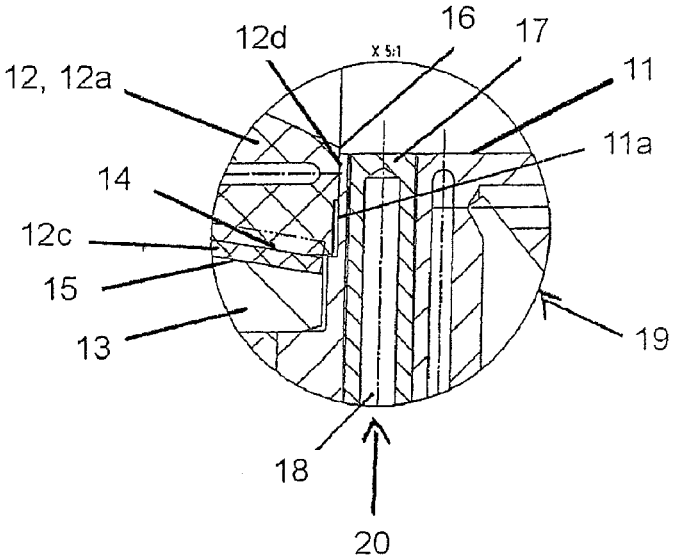
FIG. 3 is an enlarged detail view of the circled portion 20 of FIG. 2.

The mold illustrated in FIGS. 1 to 3 is constructed as follows.

Mold 10 comprises a guide 12 for molten metal, the guide being formed for example as nozzle plate 12*a* in the case of a horizontal casting mold. Nozzle plate 12*a* is disposed substantially perpendicular to the flow direction or strand withdrawal direction and has a kidney-shaped nozzle aperture 12*b* in the lower region of nozzle plate 12*a*. In operation, molten metal flows through nozzle aperture 12*b* and fills the space in the mold or channel downstream of nozzle plate 12*a* in the direction of flow or strand withdrawal direction. Mold 10 further has a running surface 11 which is disposed downstream of nozzle plate 12*a* in strand withdrawal direction S. Running surface 11 comprises a cooling system 19 known per se which cools the running surface down to the target temperature. Following on from nozzle plate 12*a* is disposed a lubricating oil supply system 20 which may, for example, have a plurality of graphite pins 17 distributed around the circumference of running surface 11. Graphite pins 17 are each provided with a hole 18 for the oil supply through which holes oil is pressed into graphite pins 17, the oil exiting on running surface 11 and being used to lubricate the strand (FIG. 3).

Nozzle plate 12*a* is supported in a holding element 13 which is firmly joined, for example screwed, to a casing 10*a* of the mold. In this case, holding element 13 is designed as a holding ring. As already particularly easy to see in FIG. 3, nozzle plate 12*a*, formed in a circular shape in cross-section, has an outer circumferential surface 14 that is conical in shape. Here outer circumferential surface 14 tapers towards strand withdrawal direction S. An inner surface 15 of holding element 13 is formed complementarily conical to outer circumferential surface 14 of nozzle plate 12*a* and rests on it in the installed condition. Nozzle plate 12*a* and holding element 13 thereby form a tapered press-fit. As result of this, outer circumferential surface 14 of nozzle plate 12*a* is loaded with a radial force that induces a compressive stress in nozzle plate 12. The conical arrangement of the relevant contact surfaces of nozzle plate 12*a* and holding element 13 moreover enable axial support of nozzle plate 12*a* by which a compact and rugged design of the mold is achieved.

Disposed between holding element 13 and mold 10 may be an elastic element 12*c*, a felt insert for example, by which equalization of the contact pressure is achieved. The felt insert may be dispensed with such that the inner circumferential surface of holding element 13 rests directly on outer circumferential surface 14 of nozzle plate 12*a*. Provided on the front face end in strand withdrawal direction S of nozzle plate 12*a* is a projection 12*d* which is machined as a sealing surface. This projection 12*d* rests on a radial outer edge of running surface 11*a* such that nozzle plate 12*a* is secured axially. Here projection 12*d* forms an overhang 16 which protrudes over running surface 11 in the radial direction. Overhang 16 serves to compensate the change in diameter due to the thermal expansion of nozzle plate 12*a* such that in operation no edge opposing strand withdrawal direction S of running surface 11 is formed.

Holding element 13 is designed, as mentioned, as a holding ring, in particular as a tapered ring with radial flange which is attached to the casing of mold 10.

For radial prestressing of nozzle plate 12*a*, a shrink-fit between nozzle plate 12*a* and holding element 13 may also be used whereby in this case the contact surfaces are formed cylindrically. A further possibility of applying the radial prestress is to dispose a sleeve, which is radially stressed, on the outer circumference of nozzle plate 12*a*. It is also possible to distribute a plurality of radially disposed screws around the outer circumference of nozzle plate 12*a*, the screws pressing each of the arched holding pieces against the outer circumference of nozzle plate 12*a*.

Figure 4:
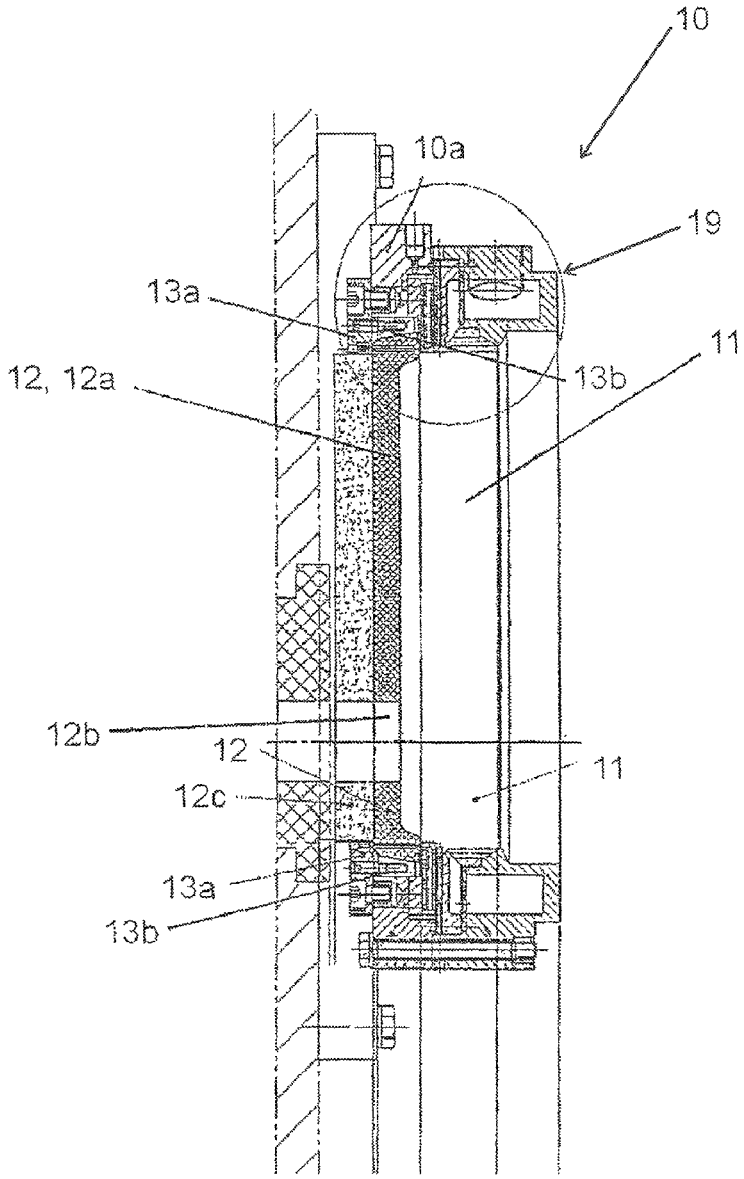
FIG. 4 is a longitudinal sectional view through a mold according to a further embodiment of the invention.
Figure 5:
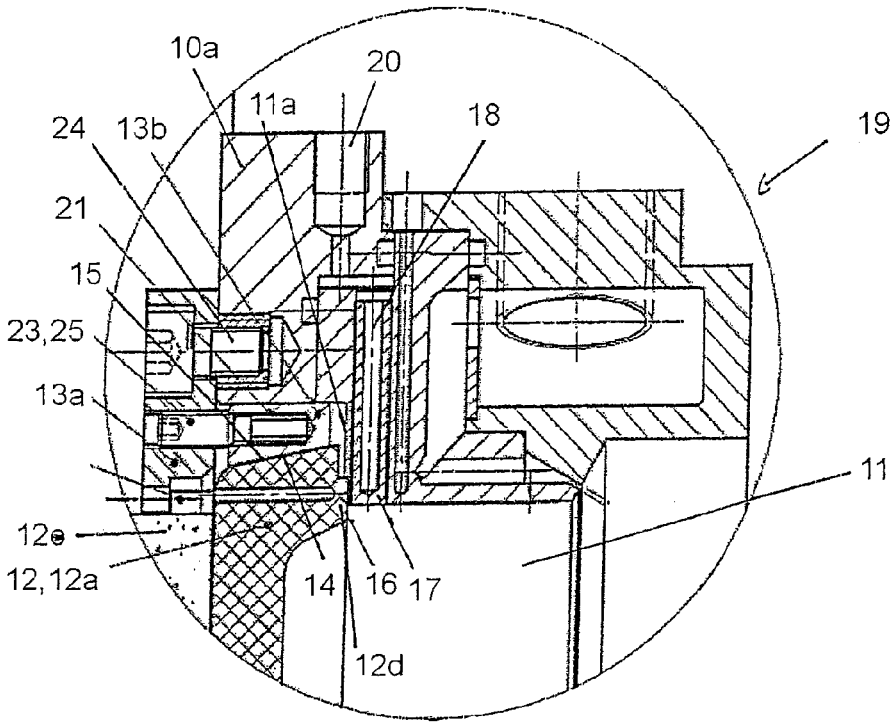
FIG. 5 is an enlarged detail view of the circled portion 19 according to FIG. 4.

FIGS. 4 and 5 illustrate a further embodiment of the invention in which holding element 13, in particular the holding ring, is designed in two parts. This means that holding element 13 comprises at least two components that are joined together for the assembly of nozzle plate 12*a*. The holding element may also be made up of more than two components. The installation position of holding element 13 in the embodiment according to FIG. 4 corresponds substantially to the installation position of holding element 13 in the embodiment according to FIG. 1. Unlike the embodiment according to FIG. 1, holding element 13 according to FIGS. 4 and 5 comprises a fastener 13*a* and a clamp 13*b*, wherein fastener 13*a* and clamp 13*b* are prestressed against each other in the axial direction of the mold, i.e. in strand withdrawal direction S. Here, fastener 13*a* comprises a nozzle clamping ring or assembly ring. Clamp 13*b* comprises a compression ring. As illustrated in FIG. 5, fastener 13*a* or the nozzle clamping ring is screwed or generally joined to casing 10*a* of the mold in the installed condition. Provided for this purpose on the outer circumference of fastener 13*a* are several openings that align with correspondingly disposed threaded holes in casing 10*a*. Fastener 13*a* is screwed to casing 10*a* by fixing screws 24 whereby fastener 13*a* or the nozzle clamping ring rests on an outer surface 10*b* of casing 10*a*, the surface extending substantially perpendicular to the strand withdrawal direction. This means that fastener 13*a* or the nozzle clamping ring is disposed substantially coplanar with nozzle plate 12*a* or generally with guide 12. Fastener 13*a* also has threaded holes for prestressing means 25, in particular for grub screws 23. Prestressing means 25 are distributed at equal distances around the circumference of fastener 13*a*. As illustrated in FIG. 6*b*, provided around the same circumference as prestressing means 25 or grub screws 23 are fitting screws 22. This means that fastener 13*a* or the nozzle clamping ring has holes for both fitting screws 22 as well as holes for grub screws 23 whereby, for example, four holes may be provided for fitting screws 22 and eight holes for grub screws 23. A different number of holes is possible for fitting screws 22 and grub screws 23 respectively. The function of fitting screws 22 relates primarily to assembly and is explained in greater detail in connection with the assembly process on the basis of FIGS. 6*a* to *h*.

As illustrated in FIG. 5, clamp 13*b* is associated with fastener 13*a*. Clamp 13*b* is designed, similar to the embodiment according to FIGS. 1 to 3, as a conical holding ring, in particular as a compression ring. Unlike the embodiment according to FIG. 1, clamp 13*b* is not directly joined to casing 10*a*. Clamp 13*b* or the compression ring is rather joined to fastener 13*a* or to the nozzle clamping ring. For this purpose, clamp 13*b* or the compression ring has a plurality of holes formed in a face surface and distributed around the circumference, in each of which holes is disposed a compression spring 21. This can also be seen clearly in FIG. 6*a*. The holes in clamp 13*b* with compression springs 21 are aligned in the installation position with the holes for grub screws 23 or prestressing means 25 such that grub screws 23 engage with compression springs 21 in the holes in clamp 13*b*. At the same time, compression springs 21 are compressed such that fastener 13*a* and clamp 13*b* are prestressed against each other in the mold's axial direction. This means that clamp 13*b* and fastener 13*a* are pushed apart by a spring force. Clamp 13*b* is adapted in such a way, in particular by a conical inner surface 15, that the axial prestress between fastener 13*a* and clamp 13*b* has a radial component in the region of inner surface 15 that is introduced into nozzle plate 12*a*.

As a result, a press-fit joint is created between holding element 13, in particular clamp 13*b* of holding element 13, and guide 12, in particular nozzle plate 12*a*, by which guide 12 or nozzle plate 12*a* is loaded with a radial prestress.

Figure 6A:
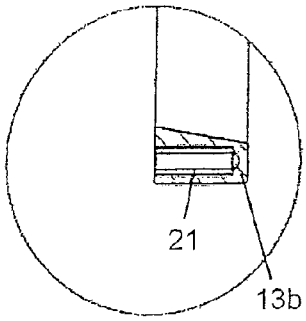
FIGS. 6*a*-6*h* is a series of assembly steps for assembly of the mold according to FIG. 4.
Figure 6B:
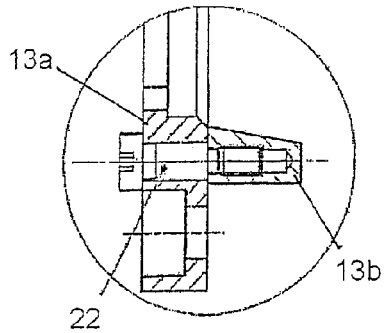
Figure 6C:
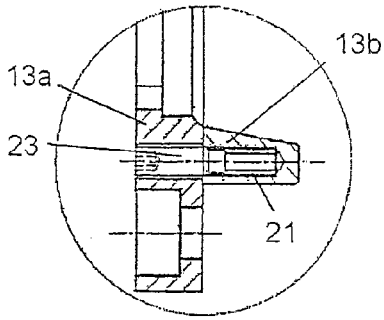

The process for producing the mold in accordance with the embodiment according to FIGS. 4, 5 is described based on FIGS. 6*a* - 6*h*. In this case, the springs, in particular compression springs 21, are first inserted into clamp 13*b* or the compression ring (FIG. 6*a*). Fastener 13*a* or the nozzle clamping ring and clamp 13*b* or the compression ring are then joined to fitting screws 22 (FIG. 6*b*). In this condition grub screws 23 are screwed into the holes provided therefor, which are aligned with the holes in clamp 13*b* in which holes are disposed compression springs 21. This places compression springs under stress such that fastener 13*a* and clamp 13*b* are prestressed against each other.

Figure 6D:
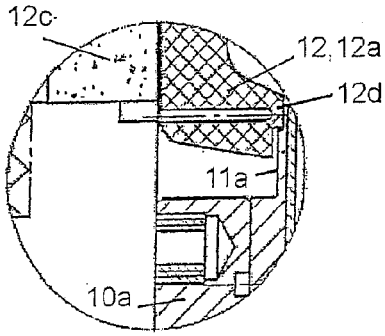
Figure 6E:
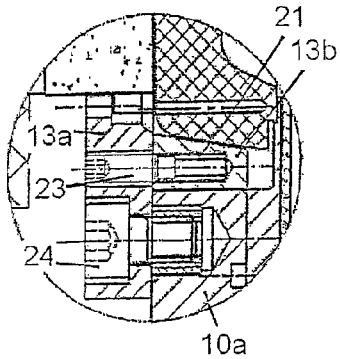
Figure 6F:
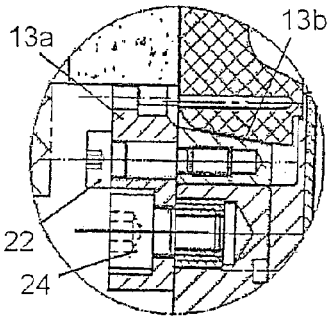

Prior to insertion of holding element 13, nozzle plate 12*a* and transition piece 12*e* are aligned centrally (FIG. 6*d*). Then the arrangement of fastener 13*a* and clamp 13*b* or the arrangement of the nozzle clamping ring and the compression ring is inserted into the mold. Fastener 13*a* is firmly screwed to casing 10*a* by fixing screws 24 (FIG. 6*e*). Fitting screws 22 are removed whereby advantageously fitting screws 22 are unscrewed step by step and in a crosswise pattern.

Figure 6G:
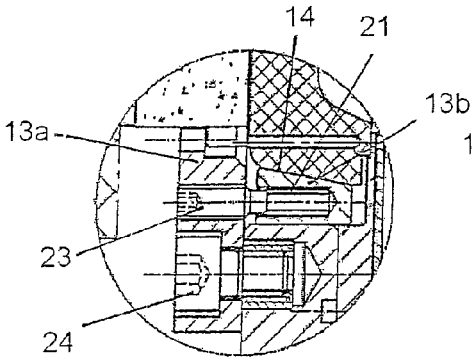
Figure 6H:
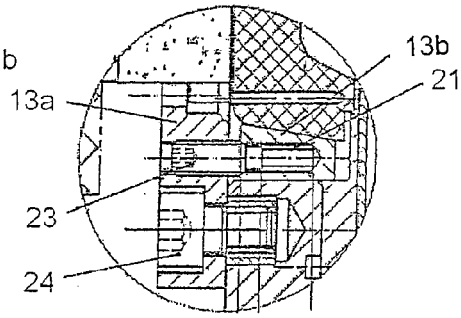

As a result, clamp 13*b* is disposed movably relative to fastener 13*a*. The gap between nozzle plate 12*a* and casing 10*a* is sufficiently large for this. Therefore, because of the axial prestress between clamp 13*b* and fastener 13*a*, clamp 13*b* is automatically positioned on the cone of nozzle plate 12*a*, i.e. on outer circumferential surface 14 of nozzle plate 12*a* (FIG. 6*g*).

Then grub screws 23 are only screwed in until the limit stop of grub screws 23 becomes apparent on clamp 13*b*. This ensures that radial prestressing of the nozzle ring is applied essentially over compression springs 21, the prestressing being evenly distributed over the circumference of nozzle plate 12*a*.

Figure 7A:
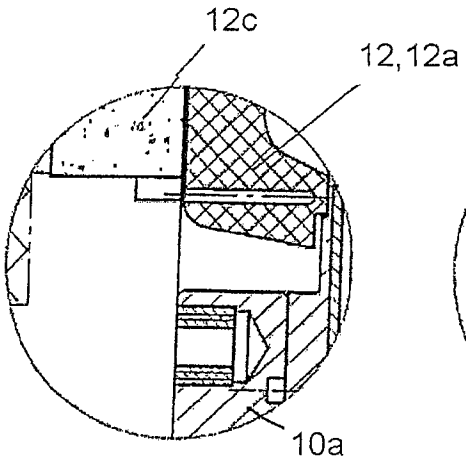
FIGS. 7*a*-7*c* are a series of alternative assembly steps for assembly of a mold according to a further embodiment.
Figure 7B:
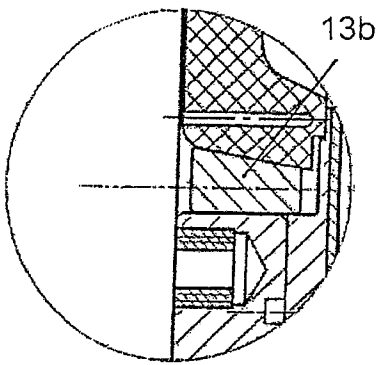
Figure 7C:
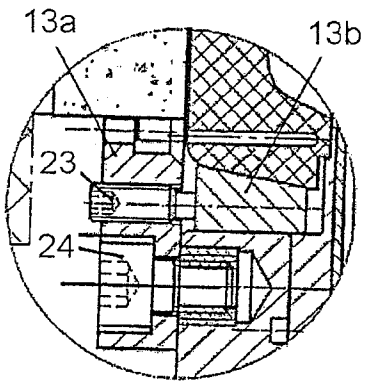

FIGS. 7*a* to 7*c* describe a further embodiment of the invention which is based on the same principle as the embodiment according to FIGS. 4 and 5.

The embodiment according to FIGS. 7*a* to 7*c* is based on a prestress acting in the axial direction between clamp 13*b* and fastener 13*a*. For this, holding element 13 is constructed similarly to holding element 13 according to FIGS. 4 and 5 and accordingly comprises a fastener 13*a* in addition to a clamp 13*b* associated therewith, which may be designed as a nozzle clamping ring and a compression ring respectively. Unlike the embodiment according to FIGS. 4 and 5, no compression spring is provided in clamp 13 in the embodiment according to FIGS. 7*a* to 7*c*. The axial prestress between clamp 13*b* and fastener 13*a* is only brought about in this case by grub screws 23, which in the installation condition (FIG. 7*c*) rest on the face surface of clamp 13*b*, i.e. the front surface of clamp 13*b* or of the compression ring, the surface being disposed perpendicular to the mold's axial direction. By screwing in grub screws 23, clamp 13*b* is pressed onto conical outer circumferential surface 14 of nozzle plate 12*a* and loads it with a radial prestress.

The embodiment according to FIGS. 7*a* to 7*c* enables a very simple method of construction in which even application of the radial prestress of nozzle plate 12*a* is achieved by tightening grub screws 23 with a constant torque. Instead of grub screws 23, other prestressing means 25 may be used and which exert a spring force on clamp 13*b*. The joint between fastener 13*a* and casing 10*a* may be achieved using other elements instead of fixing screws 24. The same applies to fitting screws 22 which may be replaced by other joining means.

The invention is also applicable to vertical casting molds whereby instead of nozzle plate 12*a* the thermal cover's inner ring, which is made of refractory material, is radially prestressed. Due to the comparatively long axial extension of the thermal cover's inner ring, radial prestressing is preferably effected by a shrink ring disposed on the outer circumference of the inner ring.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A mold (10) for continuous casting of metal, the mold comprising a coolable running surface (11) and a guide (12) for molten metal, the guide comprising a refractory material, wherein the guide (12) is disposed upstream of the running surface (11) in a direction of flow, wherein the guide (12) is radially prestressed and comprises a nozzle plate (12*a*) disposed substantially perpendicular to the direction of flow and a projection (12*d*) provided at an outer end of the nozzle plate (12*a*) and extending toward the direction of flow, wherein the guide (12) is press-fitted to a holding element (13) which comprises a fastener (13*a*) and a clamp (13*b*), wherein an outer circumferential surface (14) of the guide (12) and an inner circumferential surface (15) of the holding element (13) are each conical in design and the fastener (13*a*) and the clamp (13*b*) are prestressed in the mold's axial direction, wherein the prestress between the clamp (13*b*) and the fastener (13*a*) acting in the axial direction of the mold (10) has a radial component in a region of the guide (12), such that the guide (12) is loaded with a radial prestress.

2. The mold according to claim 1, wherein the guide (12) comprises a thermal cover which forms an axial flow channel.

3. The mold according to claim 1, wherein the holding element is a holding ring.

4. The mold according to claim 3, wherein the holding ring is designed in two parts.

5. A process for producing a mold according to claim 1, the method comprising joining the guide (12) to the coolable running surface (11), radially prestressing the guide (12), joining the guide (12) to the holding element (13), and prestressing the fastener (13*a*) and the clamp (13*b*) in the mold's axial direction.

6. The process according to claim 5, wherein the fastener and the clamp are prestressed against each other.

7. The mold according to claim 1, wherein the inner circumferential surface of the holding element circumferentially surrounds at least a portion of the outer circumferential surface of the guide.

* * * * *